US005742217A

United States Patent [19]

Bent et al.

[11] Patent Number: 5,742,217

[45] Date of Patent: Apr. 21, 1998

[54] HIGH TEMPERATURE SUPERCONDUCTOR LEAD ASSEMBLY

[75] Inventors: Bruce R. Bent, Scituate; Anthony J. Rodenbush, Marlborough; William E. Brockenborough, Brighton, all of Mass.

[73] Assignee: American Superconductor Corporation, Westborough, Mass.

[21] Appl. No.: 579,304

[22] Filed: Dec. 27, 1995

[51] Int. Cl.[6] ..... H01F 1/00

[52] U.S. Cl. ..... 335/216; 505/473

[58] Field of Search ..... 335/216; 505/473, 505/475, 818, 701–8, 419.1

[56] References Cited

U.S. PATENT DOCUMENTS

| | | | |
|---|---|---|---|
| 4,600,802 | 7/1986 | Ihas et al. . | |
| 4,688,132 | 8/1987 | Dustmann | 335/216 |
| 5,247,800 | 9/1993 | Mruzek et al. . | |
| 5,260,266 | 11/1993 | Herd et al. . | |
| 5,276,281 | 1/1994 | Sato et al. . | |
| 5,298,679 | 3/1994 | Wu et al. . | |
| 5,302,928 | 4/1994 | Laskaris et al. . | |
| 5,376,625 | 12/1994 | McCune | 505/473 |
| 5,396,206 | 3/1995 | Herd et al. . | |

FOREIGN PATENT DOCUMENTS

| | | |
|---|---|---|
| 0 472 333 A2 | 2/1992 | European Pat. Off. . |
| WO 92/22915 | 12/1992 | WIPO . |

OTHER PUBLICATIONS

Niemann et al., "Design of a High–Temperature Superconductor Current Lead for Electric Utility SMES", 1994 Applied Superconductivity Conference, Oct. 16–21, Boston.

*Primary Examiner*—Lincoln Donovan
*Attorney, Agent, or Firm*—Fish & Richardson P.C.

[57] ABSTRACT

A high temperature superconductor lead assembly for reduces the heat leak into a cryocooled magnet system includes a superconductor and a first lead connector bonded to a first end of the superconductor. The lead connector includes an electrically insulating, thermally conductive ceramic mount for attachment to a mechanical cryocooler for cooling the connector. The superconductor is in the form of a stack of ribbons. The superconductor is attached to an electrically and thermally insulating support. A cryocooled magnet system includes a mechanical cryocooler having a warm end and a cold end, a superconductor magnet maintained at a temperature of the cold end of the cryocooler, two superconductor leads, and two current carrying leads for supplying power to the superconductor leads.

20 Claims, 4 Drawing Sheets

HIGH TEMPERATURE SUPERCONDUCTOR LEAD ASSEMBLY

BACKGROUND OF THE INVENTION

This invention relates to high temperature superconductor leads, and particularly to high temperature superconductor leads for carrying current to a superconductor magnet.

Resistance heating produced by traditional copper leads when passing high currents creates a significant amount of heat leak into cryocooled superconductor magnet systems. Additional refrigeration is required to overcome the heat leaking into the system to maintain the superconductor at a desired cryogenic temperature.

Bulk superconductor leads in the form of pure castings of superconducting ceramic, generally in the form of rods or tubes with metallic end caps, have been used to supply power from non-superconductor leads to superconducting magnets. These bulk leads are difficult to handle because the pure ceramic is brittle at cryogenic temperatures. There is also significant resistive heat associated with the contact between the bulk material and the metallic end caps resulting in heat leak into the cryocooled superconductor magnet system.

Bulk superconductor leads have included heat-sinking connections between the copper leads that supply power to the superconductor leads and the cryocooler. As shown in FIG. 1, prior art bulk superconductor leads 2 carry current to a superconductor magnet 4 connected to a cold end 5 of a cryocooler 8. Copper leads 6 pass through enclosure 1 and include a connection 3 to a warm end 7 of cryocooler 8. The heat sinking to the cryocooler is from the warm side (copper lead 6 side) of the contact area between the bulk material and the metallic end caps 9 of the leads. Thus the resistive heat associated with the contact between the ceramic bulk material and the metallic end caps still leaks into the cryocooled superconductor magnet system. The resistive heat in bulk leads carrying about 5500 Amps can be as high as about 1.15 W/kA per pair of leads. The resistive heat leak, combined with about 0.04 W/kA per pair of conductive heat leak, requires about 595 W/kA per pair of additional refrigeration (at 4 Kelvin, about 500 W of refrigeration is required per Watt of heat leak into the cryocooled system).

A thermal stabilizer may be included in a superconductor lead to prevent damage to the superconductor magnet under conditions of loss of cooling. To thermally stabilize a superconductor lead, either for a bulk lead or a stacked composite lead, the lead is pressed or soldered to a material having a low thermal conductivity, for example, a stainless steel or brass wire, rod or bar. This permits the magnet to be discharged before the superconductor lead fails. Alternatively, an electrical by-pass path may be included in parallel with the superconductor lead to permit discharge of the magnet in case of loss of superconductivity or damage in the leads.

SUMMARY OF THE INVENTION

The invention relates to a high temperature superconductor lead assembly which reduces the heat leak into a cryocooled magnet system. The high temperature superconductor lead assembly includes a superconductor and a first lead connector bonded to a first end of the superconductor. A mount attaches the lead connector to a mechanical cryocooler for cooling the connector.

In particular embodiments of the invention, the superconductor is in the form of a stack of ribbons or a plurality of stacks of ribbons. The superconductor is attached to an electrically and thermally insulating support. An outer support surrounds the superconductor and is connected to the lead connector. The mount is an electrically insulated, thermally conductive ceramic such as beryllium oxide or aluminum nitride. The assembly includes a lead connector with a current lug for connection of the superconductor lead to a power source. A second lead connector bonded to a second end of the superconductor includes a mount for attachment of the lead connector to a superconductor magnet. The superconductor magnet is at a lower temperature than the temperature at a point of attachment of the cryocooler to the first lead connector.

According to another aspect of the invention, a cryocooled magnet system includes a mechanical cryocooler having a warm end and a cold end, a superconductor magnet maintained at the temperature of the cold end of the cryocooler, two superconductor leads including mounts for attachment to the warm end of the mechanical cryocooler, and two current carrying leads each connected to one of the superconductor leads for supplying power from a power source to the superconductor leads.

In particular embodiments of the invention, the current carrying leads are copper blocks. Copper straps connect the superconductor lead mounts to the warm end of the mechanical cryocooler. The mechanical cryocooler warm end is at about 60 Kelvin and the mechanical cryocooler cold end is at about 10 Kelvin.

Advantages of the system may include one or more of following. The superconductor lead is mechanically stable and easy to handle. A mount is provided on the superconductor lead that is thermally conductive but electrically insulated for connection of the superconductor lead to the cryocooler. The number of superconductor ribbons in a stack and the number of stacks in a lead can be adjusted for the desired current carrying capacity.

BRIEF DESCRIPTION OF THE DRAWINGS

Other objects, features and advantages of the invention will be apparent from the following description taken together with the drawings in which.

DESCRIPTION OF THE PREFERRED EMBODIMENT

Figure 1:
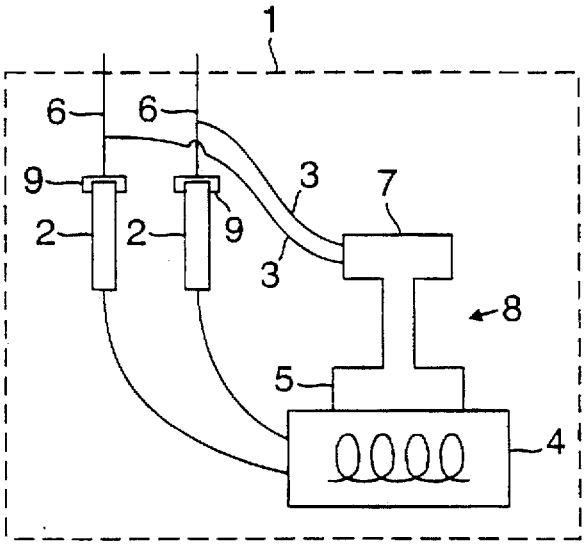
FIG. 1 PRIOR ART
FIG. 1 is a schematic of a prior art cryocooled magnet system.
Figure 2:
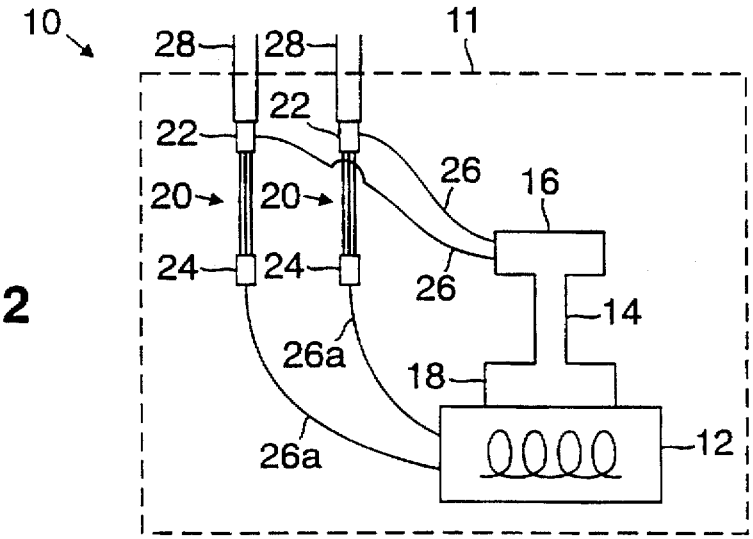
FIG. 2 is a schematic of a cryocooled magnet system in accordance with the invention.

Referring to FIG. 2, a cryocooled magnet system 10, such as can be used in a magnetic resonance imaging system and other similar applications, includes an enclosure 11 containing a low or high temperature superconductor magnet 12, a two stage mechanical cryocooler 14, such as a GB37, available from Cryomech, Syracuse, N.Y., having a warm end 16 and a cold end 18, superconductor leads 20 having warm ends 22 and cold ends 24, and an upper stage, for example, copper blocks 28, which pass from a power source (not shown) through the enclosure wall and attach to warm ends 22 of superconductor leads 20. Warm ends 22 of superconductor leads 20 are attached to warm end 16 of cryocooler 14 by, for example, copper straps 26, and cold ends 24 are attached to superconductor magnet 12 by, for example, copper straps 26*a*. For a low temperature superconductor magnet, warm end 16 of cryocooler 14 is generally in the range of about 40 to 100 Kelvin, preferably, about 60 to 80 Kelvin, and cold end 18 is generally in the range of about 4 to 20 Kelvin, most preferably, about 4 Kelvin. For a high temperature superconductor magnet, the warm end 16 of cryocooler 14 is also in the range of about 40 to 100 Kelvin, preferably, about 60 to 80 Kelvin, and cold end 18 is generally in the range of about 4 to 60 Kelvin, preferably about 4 to 20 Kelvin, the chosen temperature depending upon the temperature requirements of the particular magnet.

Figure 3:
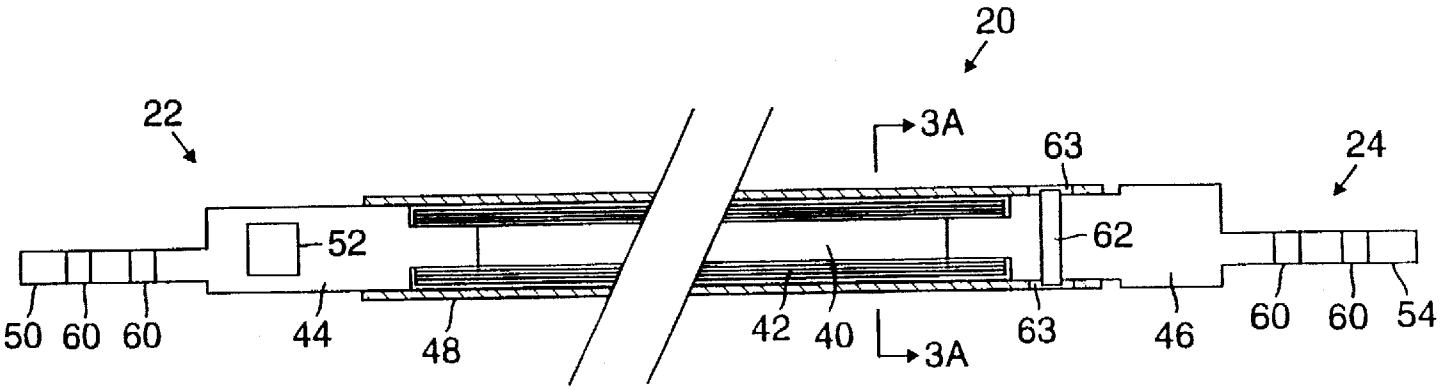
FIG. 3 is a schematic of a superconductor lead.

Referring to FIG. 3, superconductor lead 20 includes an inner support 40 to which high temperature composite superconductors 42 are mounted (either continuously along their length or at discrete locations along their length by, for example, epoxy), a warm end lead connector 44, a cold end lead connector 46, and an outer support 48. Outer support 48 has an outer diameter in the range of about ⅜" to 1.0" and an inner diameter of about ⅛" smaller than the outer diameter and provides for ease of handling of lead 20 but need not be included for proper functioning of the lead.

inner and outer supports 40, 48 are formed from, for example, a material that is a good electrical and thermal insulator such as fiberglass epoxy composite tubing. G10 tubing, manufactured as Garolite by Spaulding Composites, Rochester, N.H., is a suitable material. G10 tubing has a thermal conductivity in the warp and fill direction of 0.0035 W/cm-K and in the direction perpendicular to weave of 0.0027 W/cm-K, a breakdown voltage of 10 kV/mm, is not brittle at low temperature, can be machined with ordinary tools, and has a very low contribution to the heat load of the system. The total thermal contraction of G10 tubing, being about 0.23% from 300K to 77K, is close to that of superconductor 42. The G10 tubing also has sufficient strength to provide for ease of handling of superconductor lead 20 (Young's modulus of G10 tubing in the warp direction is 36 GPa, in the fill direction is 31 GPa, and in the direction perpendicular to weave is 23 GPa at cryogenic operating temperatures, e.g. 77K).

Warm end lead connector 44 includes a current lug 50 for attachment to copper block 28 of the upper stage, and a mount, for example, thermal contact 52, for attachment of copper straps 26 leading to warm end 16 of cryocooler 14. Cold end lead connector 46 includes a current lug 54 for attachment of copper straps 26*a* leading to magnet 12. Lead connectors 44 and 46 are made from, for example, a block of ETP or other copper alloy or from silver. The copper alloy can be nickel plated to avoid corrosion though this raises the resistance of the connections of lead connectors 44 and 46 to copper block 28. Thermal contact 52 is made from, for example, an electrically insulating, thermally conductive ceramic having a resistivity greater than about $10^{16}$ Ω-cm and a thermal conductivity greater than about 6 W/cm° C. Suitable materials include beryllium oxide and aluminum nitride.

The connection of warm end thermal contact 52 to cryocooler 14 provides, significantly, a heat sink on the superconductor side, or cold side, of the electrical connection of the warm end 22 of superconductor lead 20 to copper block 28 to sink the resistive heating of the connection by conduction. Heat sinking at the warm end rather than at the cold end temperature saves significant refrigeration. For example, it takes about 50 W of refrigeration to sink 1 W of heat at the warm end (about 60 Kelvin), whereas it takes about 500 W of refrigeration to sink 1 W of heat at the cold end (about 10 Kelvin). It is therefore preferable to provide a connection from the warm end of superconductor lead 20 to the warm end of the cryocooler because it takes substantially less power to sink the resistive heat of the connection of copper block 28 to lead 20 at the higher temperature. For a magnet operating at 4 Kelvin, the heat leak into the cryocooled magnet for a structure as illustrated in FIGS. 2 and 3, is only about 200 mW/kA per pair of leads, about 25% being from resistive heating and the remainder from conductive heating. The additional refrigeration required at the cold end is only about 100 W/kA per pair.

Figure 3A:
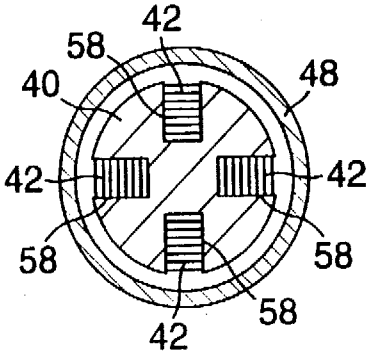
FIG. 3A is a cross-sectional view taken along line 3A—3A of FIG. 3.
Figure 3B:
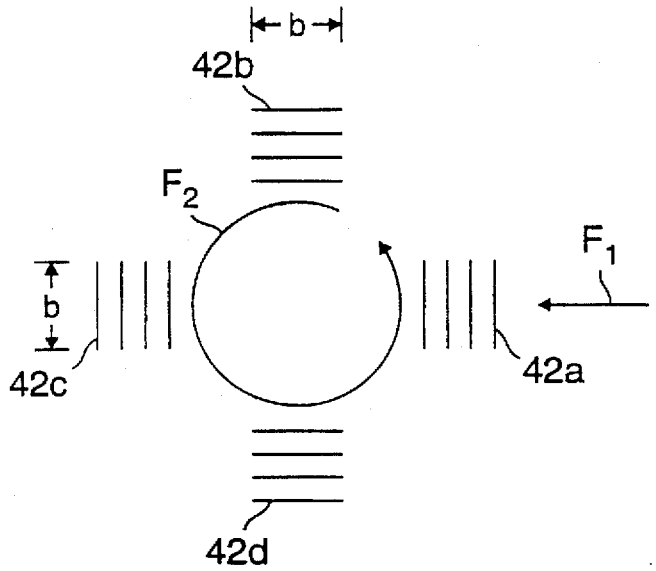
FIGS. 3B and 3C are schematic views of the field orientations in the superconductor lead.
Figure 3C:
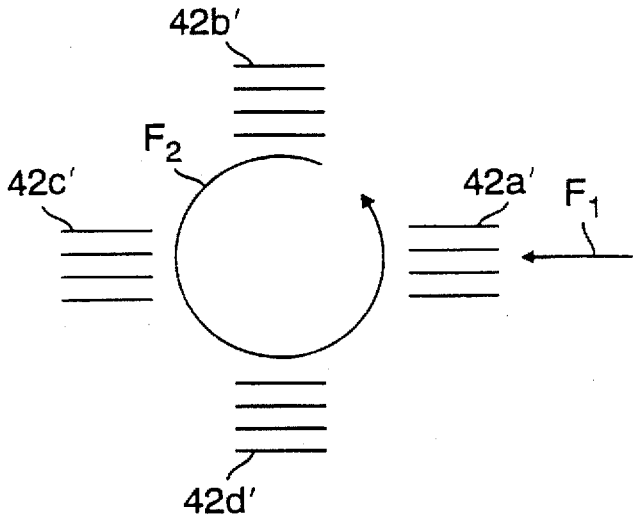

As can be seen in FIGS. 3A–3C, multiple stacks of composite superconductor 42 (four stacks being shown) are located within channels 58 of inner support 40. Because of the anisotropy of composite superconductor 42, it is advantageous to align the good or b direction of the superconductor with an external field $F_1$ and with a self-field $F_2$. While the self-field degrades superconductor performance, its effect is lessened when it is aligned along the good direction of the superconductor. Referring to FIG. 3B, stacks 42*b* and 42*d* are aligned with external field $F_1$ and all four stacks 42*a*–42*d* are aligned with self-field $F_2$. Referring to FIG. 3C, all four stacks 42*a*'–42*d*' are aligned with external field $F_1$ and stacks 42*b*' and 42*d*' are aligned with self-field $F_2$.

Figure 4A:
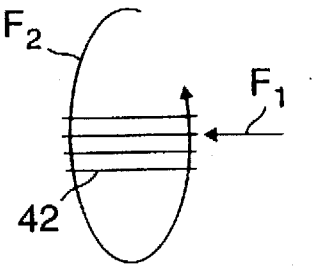
FIG. 4A is a schematic view of the field orientations in the superconductor lead of FIG. 4.
Figure 4:
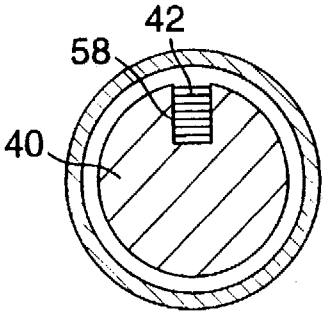
FIG. 4 is a cross-sectional view similar to that of FIG. 3A of an alternative embodiment of a superconductor lead.

Referring to FIGS. 4 and 4A, a one stack composite superconductor 42 located within a channel 58 has the advantage of being able to be aligned with the applied field but the disadvantage of a larger perpendicular "bad" self-field. If the superconductor lead is acting in a low magnetic environment, for example, below about 2,000 gauss at a warm end temperature of about 64K, the configuration of FIG. 3B is preferred because the predominant field is a self-field. If the superconductor lead is acting in a high magnetic environment, while the four stack configuration of FIG. 3C is preferred over the four stack configuration of FIG. 3B, the one stack configuration of FIG. 4 is generally preferred over multi-stack configurations. This is because for the same current carrying capacity, the one stack configuration is easier to manufacture and has a higher number of individual ribbons in the stack making the stack more robust and easier to handle.

In the illustrated embodiment of the invention, high temperature composite superconductor 42 is formed of superconducting ribbon elements which are about 10 mil thick by 170 mil wide and which are about 10 to 80 cm in length. The elements are preferably stacked and sintered to take advantage of the superconductor anisotropy. Composite superconductor 42 has low thermal conductivity, for example, about 0.45 W/cm-K in the range of 4 to 60K, and experiences virtually no resistance heating at or below its operating temperatures, currents, and magnetic fields. The number and depth of channels 58 and the number of ribbon elements in a stack are determined by the amount of current carrying capacity desired, for example, for a 77K warm end, a stack of 16 tapes as described below can carry about 500 A with no applied field.

For example, superconducting ceramics of the oxide, sulfide, selenide, telluride, nitride, boron carbide or oxycarbonate types, in a supporting matrix, may be used. Superconducting oxides are preferred, for example, members of the rare earth (RBCO) family of oxide superconductors; the bismuth (BSCCO) family of oxide superconductors; the thallium (TBCCO) family of oxide superconductors; or the mercury (HBCCO) family of oxide superconductors may be used. Silver and other noble metals are the preferred material for the matrix supporting or binding the superconducting ceramic. Alloys substantially comprising noble metals, including oxide dispersion strengthened (ODS) silver, such as $Al_2O_3$—Ag, may be used. By "noble" are meant metals which are substantially non-reactive with respect to superconducting ceramics and precursors and to the gasses required to form them under the expected conditions (temperature, pressure, atmosphere) of manufacture and use. Preferred noble metals include silver (Ag), gold (Au), platinum (Pt) and palladium (Pd). A Au/Ag alloy matrix in the range of 1 to 15 atomic percent, preferably 3 atomic percent, is the preferred matrix.

Figure 5A:
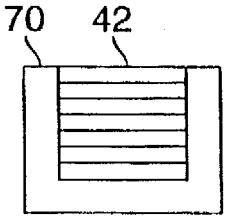
FIG. 5A is a cross-sectional view taken along lines 5A—5A of FIG. 5.
Figure 5:
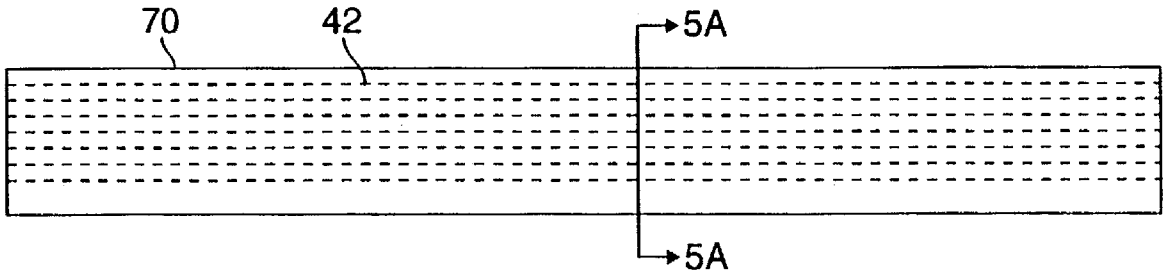
FIG. 5 is a schematic view of a thermal stabilizer for the superconductor lead.
Figure 6A:
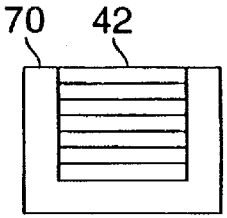
FIG. 6A is a cross-section view taken along lines 6A—6A of FIG. 6.
Figure 6:
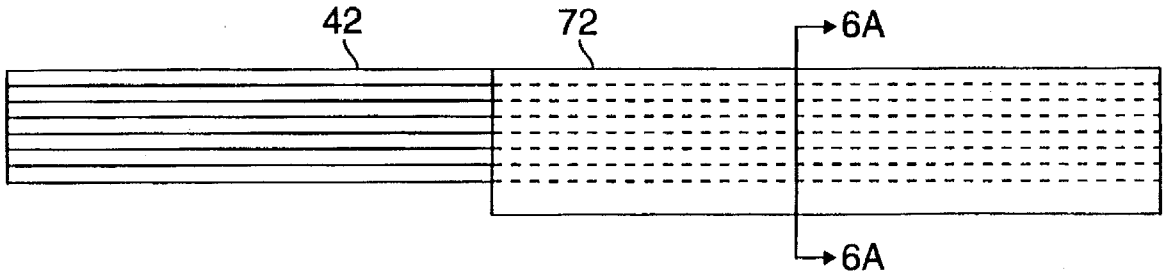
FIG. 6 is a schematic view of an alternate embodiment of a thermal stabilizer for the superconductor lead.

Superconductor lead 20 is generally used in systems having a current carrying capacity of 50 to 2,000 Amps. At these currents, a thermal stabilizer is not needed to protect the magnet from a loss of cooling because the small magnets in these systems can be shut down without damage in a couple of seconds. Referring to FIGS. 5 and 5A, if desired, a thermal stabilizer can be provided by bonding a stainless or brass bar 70 to superconductor 42 to add thermal mass to the lead preventing a rapid temperature rise in the event of loss of cooling at the warm end of the lead. Superconductor 42 can be soldered to a bar 70 that extends the entire length of the superconductor (FIGS. 5 and 5A) or to a bar 72 which only extends along a part of the length of the superconductor, for example, about half-way, from the warm end (FIGS. 6 and 6A). The embodiment of FIG. 6 is preferred because it stabilizes the warm end while conducting less heat to the cold end than the stabilized lead of FIG. 5. During assembly, bar 70 is mounted in channel 58 with, for example, epoxy. Bar 72 can similarly be mounted in channel 58 with an additional piece of G10 material (not shown) having the same configuration as bar 72 extending along and bonded to the remainder of the length of the superconductor in channel 58.

Referring again to FIG. 2, the structure of superconductor lead 20 provides easy installation into cryocooled magnet system 10. Current lugs 50 and 54 define bolt holes 60 for attachment to copper blocks 28 and copper straps 26*a* respectively, and thermal contact 52 provides a connection point to copper straps 26.

To assemble superconductor lead 20, superconductor 42 is bonded to inner support 40 with, for example, epoxy, at least at discrete points along the length of inner support 40 such that in a background field, caused by the magnet, which produces a bending force on the superconductor, the force on the superconductor is transferred to inner support 40 preventing damage to superconductor 42 and degradation in performance. Bonding of the superconductor to inner support 40 keeps the superconductor below its critical strain. Lead connectors 44, 46 are then soldered, forming a low resistance joint, to superconductor 42 at about 180° C. (superconductor 42 can be heated to about 200° C. without damage). Outer support 48 is then slid over the assembly.

Warm end lead connector 44 is anchored to outer support 48 by, for example, epoxy. Cold end lead connector 46 is slidably, axially secured within outer support 48 by a pin 62 and slot 63 arrangement. Thus, as the temperature is lowered, any difference in thermal contraction between superconductor 42 and the G-10 tubing of the outer support is absorbed by the sliding of lead connector 46 within outer support 48. Alternatively, it is likely desirable to have both lead connectors 44, 46 anchored to outer support During installation, the user bolts the superconductor lead to copper blocks 28 and copper straps 26*a*. Copper straps 26*a* are then connected to magnet 12. Copper straps 26*a* may also be presoldered to thermal contacts 52 or soldered to thermal contacts 52 by the user during installation and connection to cryocooler 14. By presoldering copper straps 26 to thermal contacts 52, the user need only bolt the superconductor lead in place, avoiding any damage to superconductor 42 and melting of earlier solder joints that could result from soldering at temperatures above 200° C.

Alternatively, since soldering is a lower resistance connection than bolting, superconductor lead 20 can be presoldered to copper blocks 28 and copper straps 26*a* or soldered by the user during installation. Any post-assembly soldering should be done below 180° C., preferably below 120° C.

Additions, subtractions and other modifications of the illustrated embodiments of the invention will be apparent to those practiced in the art and are within the scope of the following claims.

What is claimed is:

1. A high temperature superconductor lead assembly for carrying current to a superconductor device, comprising:

a superconductor, a first lead connector bonded to a first end of said superconductor, said lead connector including a mount for attachment to a mechanical cryocooler for cooling said connector, and a second lead connector bonded to a second end of said superconductor, said second lead connector including a mount for attachment of said lead connector to a superconductor magnet, said superconductor magnet being at a lower temperature than a temperature at a point of attachment of said cryocooler to said first lead connector.

2. The assembly of claim 1 wherein said superconductor is in the form of a ribbon.

3. The assembly of claim 2 wherein said superconductor comprises a stack of ribbons.

4. The assembly of claim 3 wherein said superconductor comprises a plurality of stacks of ribbons.

5. The assembly of claim 1 further including a support to which said superconductor is attached.

6. The assembly of claim 5 wherein said support comprises an electrical and thermal insulator.

7. The assembly of claim 1 further including an outer support surrounding said superconductor, said outer support being connected to said lead connector.

8. The assembly of claim 1 wherein said mount comprises an electrically insulating, thermally conductive material.

9. The assembly of claim 8 wherein said mechanical mount comprises beryllium oxide.

10. The assembly of claim 8 wherein said mechanical mount comprises aluminum nitride.

11. The assembly of claim 1 wherein said lead connector further includes a mechanical mount for connection of said superconductor lead to a power source.

12. A high temperature superconductor lead assembly for carrying current to a superconductor device, comprising:

a superconductor, a first lead connector bonded to a first end of said superconductor, said first lead connector including a mount for attachment to a mechanical cryocooler and for connection of said superconductor lead to a power source, a second lead connector bonded to a second end of said superconductor, said second lead connector including a mount for connection of said superconductor lead to a superconductor magnet, said superconductor magnet being at a lower temperature than a temperature at a point of attachment of said cryocooler to said first lead connector, a support comprising an electrical and thermal insulator to which said superconductor is attached, and an outer support surrounding said superconductor, said outer support being connected to said first and second lead connectors.

13. A cryocooled magnet system, comprising:

a mechanical cryocooler having a warm end and a cold end, a superconductor magnet maintained at a temperature of said cold end of said cryocooler, two superconductor leads for carrying current to said superconductor magnet, each superconductor lead including a superconductor, and a first lead connector bonded to a first end of said superconductor, said lead connector including a mount for attachment to said warm end of said mechanical cryocooler, and two current carrying leads each connected to one of said superconductor leads, said current carrying leads for supplying power from a power source to said superconductor leads.

14. The cryocooled magnet system of claim 13 wherein said current carrying leads comprise copper blocks.

15. The cryocooled magnet system of claim 13 further including copper straps for connecting said superconductor lead mounts to said warm end of said mechanical cryocooler.

16. The cryocooled magnet system of claim 13 wherein said mounts comprises beryllium oxide.

17. The cryocooled magnet system of claim 13 wherein said mounts comprises aluminum nitride.

18. The cryocooled magnet system of claim 13 further including a second lead connector bonded to a second end of said superconductor, said second lead connector including a mount for attachment to said superconductor magnet.

19. The cryocooled magnet system of claim 13 wherein said mechanical cryocooler warm end is at about 60 Kelvin.

20. The cryocooled magnet system of claim 13 wherein said mechanical cryocooler cold end is at about 10 Kelvin.

* * * * *